US010185250B2

(12) United States Patent
Watanabe

(10) Patent No.: US 10,185,250 B2
(45) Date of Patent: Jan. 22, 2019

(54) DEVELOPING DEVICE HAVING FIRST CONVEYANCE CHAMBER AND SECOND CONVEYANCE CHAMBER DISPOSED ABOVE FIRST CONVEYANCE CHAMBER, AND IMAGE FORMING APPARATUS INCLUDING SAME

(71) Applicant: KYOCERA Document Solutions Inc., Osaka (JP)

(72) Inventor: Akihiro Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/926,782

(22) Filed: Mar. 20, 2018

(65) Prior Publication Data

US 2018/0321616 A1 Nov. 8, 2018

(30) Foreign Application Priority Data

May 8, 2017 (JP) ..... 2017-092354

(51) Int. Cl.
*G03G 15/08* (2006.01)

(52) U.S. Cl.
CPC ..... *G03G 15/0893* (2013.01); *G03G 15/0891* (2013.01); *G03G 2215/0838* (2013.01)

(58) Field of Classification Search
CPC ..... G03G 15/0891; G03G 15/0893; G03G 2215/0838
USPC ..... 399/254, 256
See application file for complete search history.

(56) References Cited

U.S. PATENT DOCUMENTS

| | | | | |
|---|---|---|---|---|
| 9,046,821 | B2 * | 6/2015 | Ohmura | G03G 15/0893 |
| 2006/0029432 | A1 | 2/2006 | Arimoto et al. | 399/254 |
| 2012/0163874 | A1 * | 6/2012 | Hattori | G03G 15/0896 399/254 |
| 2015/0234323 | A1 * | 8/2015 | Furukawa | G03G 15/0891 399/254 |
| 2015/0338778 | A1 * | 11/2015 | Matsumoto | G03G 15/0893 399/254 |

(Continued)

FOREIGN PATENT DOCUMENTS

| | | | |
|---|---|---|---|
| JP | 08278698 | A * | 10/1996 |
| JP | 2006-47884 | A | 2/2006 |
| JP | 2010039070 | A * | 2/2010 |

(Continued)

*Primary Examiner* — Robert B Beatty
(74) *Attorney, Agent, or Firm* — Stein IP, LLC

(57) ABSTRACT

A developing device includes a developing container including a first conveyance chamber and a second conveyance chamber disposed above the first conveyance chamber, a first stirring-conveyance member which conveys developer in the first conveyance chamber in a first direction, a second stirring-conveyance member which conveys the developer in the second conveyance chamber in a second direction opposite to the first direction, and a developer carrier. A second communication portion is formed which allows the first and second conveyance chambers to communicate with each other at their end portions on a downstream side in the second direction. In the first conveyance chamber, a guide member is disposed which guides, to the downstream side in the first direction, the developer passing through the second communication portion to fall into the first conveyance chamber.

5 Claims, 3 Drawing Sheets

(56) References Cited

U.S. PATENT DOCUMENTS

2017/0115606 A1* 4/2017 Sakamaki ..... G03G 15/0891

FOREIGN PATENT DOCUMENTS

JP 2010164691 A * 7/2010
JP 2011002679 A * 1/2011

* cited by examiner

DEVELOPING DEVICE HAVING FIRST CONVEYANCE CHAMBER AND SECOND CONVEYANCE CHAMBER DISPOSED ABOVE FIRST CONVEYANCE CHAMBER, AND IMAGE FORMING APPARATUS INCLUDING SAME

INCORPORATION BY REFERENCE

This application is based upon and claims the benefit of priority from the corresponding Japanese Patent Application No. 2017-92354 filed on May 8, 2017, the entire contents of which are incorporated herein by reference.

BACKGROUND

The present disclosure relates to a developing device and an image forming apparatus including the same, and, in particular, the present disclosure relates to a developing device including a first conveyance chamber and a second conveyance chamber disposed above the first conveyance chamber, each incorporating a stirring-conveyance member which stirs and conveys a developer, and an image forming apparatus including such a developing device.

In an image forming apparatus, an electrostatic latent image formed on an image carrier, such as a photosensitive member, is developed by a developing device to be visualized as a toner image. A known example of such a developing device is one that includes a developing container which holds therein a developer, first and second stirring-conveyance members which convey the developer, while stirring the developer, and a developing roller (a developer carrier) which carries thereon the developer supplied thereto from the second stirring-conveyance member. The first stirring-conveyance member conveys the developer to one side in the axial direction of the developing roller, and the second stirring-conveyance member supplies the developer to the developing roller, while conveying the developer to the other side (the side opposite from the one side).

Now, in recent years, there has been an increasing demand for the miniaturization of image forming apparatuses, and in particular, in color image forming apparatuses, in which a plurality of developing devices are disposed, there has been a demand for the miniaturization of developing devices. As an example of developing devices meeting the demand, there is known one that includes a first conveyance chamber inside which a first stirring-conveyance member is disposed and a second conveyance chamber which is disposed above the first conveyance chamber and inside which a second stirring-conveyance member is disposed. In such a developing device, it is possible to miniaturize the developing device in the horizontal direction by arranging the first conveyance chamber and the second conveyance chamber one above the other. Accordingly, it is possible to reduce space for installing the developing device, and thus, it is possible to achieve the miniaturization of image forming apparatuses.

However, in the above-described developing device, there is an area where the developer is conveyed against gravity, from the first conveyance chamber to the second conveyance chamber. With this structure, when change in flowability of the developer results from factors such as durable printing and environmental variation, the circulation balance of the developer is likely to change, and thus, uneven distribution of the developer is likely to be caused inside the developing device. When, in such a condition, toner is replenished to portions where only a small amount of developer exists, it will create portions where the concentration of the replenished toner is locally high. The replenished toner is not sufficiently mixed with a carrier included in the developer and thus is low in charge amount, and accordingly, when a portion where the concentration of the replenished toner is high is used for development, it will result in problems such as fogged images and uneven image density.

To prevent such problems, there have been proposed various methods for fully mixing the developer inside the developing device with the replenished toner. For example, there is known a developing device that has a communication path through which developer is delivered from a developing chamber to a stirring chamber by the developer falling from a downstream side of the developing chamber to an upstream side of the stirring chamber in a developer conveyance direction, and in which replenished developer replenished through a developer replenishing port above the stirring chamber falls to an area in the stirring chamber where the communication path joins the stirring chamber.

SUMMARY

According to one aspect of the present disclosure, a developing device includes a developing container, a first stirring-conveyance member, a second stirring-conveyance member, and a developer carrier. The developing container includes a first conveyance chamber and a second conveyance chamber disposed above the first conveyance chamber with a partition therebetween, and holds therein a two-component developer including a carrier and a toner. The first stirring-conveyance member is rotatably supported in the first conveyance chamber, and conveys the developer in the first conveyance chamber in a first direction, while stirring the developer. The second stirring-conveyance member is rotatably supported in the second conveyance chamber to be parallel to the first stirring-conveyance member, and rotates in a direction opposite to a direction in which the first stirring-conveyance member rotates, and thereby conveys the developer in the second conveyance chamber in a second direction, which is a direction opposite to the first direction, while stirring the developer. The developer carrier is rotatably supported in the developing container, and carries on a surface thereof the developer in the second conveyance chamber. The developing container further includes a first communication portion which allows the first conveyance chamber and the second conveyance chamber to communicate with each other at end portions thereof on a downstream side in the first direction, and a second communication portion which allows the first conveyance chamber and the second conveyance chamber to communicate with each other at end portions thereof on a downstream side in the second direction. The second communication portion is formed at an end portion of the partition on a side in a width direction of the developing container which is perpendicular to an axial direction of the second stirring-conveyance member, the developer on the side being made to move upward by rotation of the second stirring-conveyance member and downward by rotation of the first stirring-conveyance member. In the first conveyance chamber, a guide member is disposed which guides, to the downstream side in the first direction, the developer that is conveyed from the second conveyance chamber, passing through the second communication portion, and falls into the first conveyance chamber.

Further features and advantages of the present disclosure will become apparent from the description of embodiments given below.

DETAILED DESCRIPTION

Figure 1:
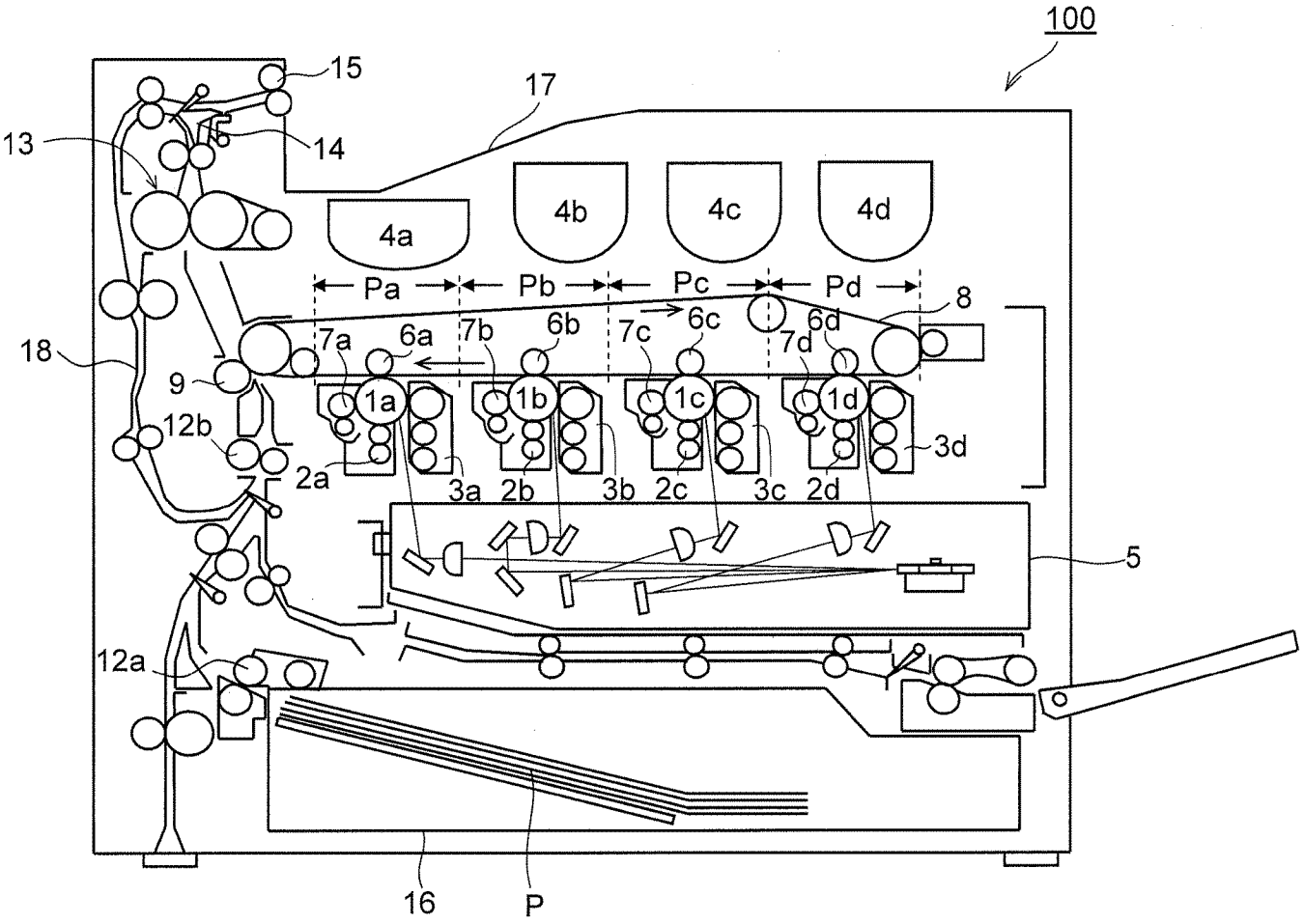
FIG. 1 is a schematic sectional view illustrating an overall configuration of a color printer including a developing device of the present disclosure.

Hereinafter, embodiments of the present disclosure will be described with reference to the accompanying drawings. FIG. 1 is a schematic sectional view of a color printer 100 including developing devices 3*a* to 3*d* of the present disclosure, and the color printer 100 illustrated in the figure is a tandem-type color printer. In a main body of the color printer 100, four image formers Pa, Pb, Pc, and Pd are arranged in order from Pd to Pa from an upstream side (the right side in FIG. 1) in a transport direction. The image formers Pa to Pd are provided corresponding to images of four different colors (black, yellow, magenta, and cyan), and sequentially form images of cyan, magenta, yellow, and black through charging, exposure, developing, and transfer processes.

The image formers Pa to Pd are each provided with a corresponding one of photosensitive drums 1*a*, 1*b*, 1*c*, and 1*d*, which each carry a visible image (a toner image) of a corresponding color, and further, an intermediate transfer belt 8, which rotates in a clockwise direction in FIG. 1, is provided adjacent to the image formers Pa to Pd.

When image data is fed from a host device such as a personal computer, chargers 2*a* to 2*d* first charge surfaces of the photosensitive drums 1*a* to 1*d* uniformly. Then, an exposure device 5 irradiates the photosensitive drums 1*a* to 1*d* with light in accordance with the image data to form an electrostatic latent image on each of the photosensitive drums 1*a* to 1*d* in accordance with the image data. The developing devices 3*a* to 3*d* are each filled, by a corresponding one of toner containers 4*a* to 4*d*, with a predetermined amount of two-component developer (which hereinafter may be referred to simply as developer) including a toner of a corresponding one of the four colors of black, yellow, magenta, and cyan, and the toner included in the developer is supplied by each of the developing devices 3*a* to 3*d* onto a corresponding one of the photosensitive drums 1*a* to 1*d* to electrostatically adhere thereto. Thereby, a toner image is formed in accordance with the electrostatic latent image, which has been formed by the exposure to the light emitted from the exposure device 5.

Then, an electric field with a predetermined transfer voltage is applied across primary transfer rollers 6*a* to 6*d* and the photosensitive drums 1*a* to 1*d* by the primary transfer rollers 6*a* to 6*d*, and black, yellow, magenta, and cyan toner images formed on the photosensitive drums 1*a* to 1*d* are primarily transferred onto the intermediate transfer belt 8. After the primary transfer, residual toner and the like left on the surfaces of the photosensitive drums 1*a* to 1*d* are removed by cleaning devices 7*a* to 7*d*.

Transfer sheets P onto one of which the toner images are to be transferred are stacked in a sheet cassette 16 disposed in a lower portion inside the color printer 100, and a transfer sheet P is conveyed at a predetermined timing via a sheet feeding roller 12*a* and a registration roller pair 12*b* to a nip portion (secondary transfer nip portion) between the intermediate transfer belt 8 and a secondary transfer roller 9 disposed adjacent to the intermediate transfer belt 8. The transfer sheet P, after having the toner images transferred thereon, is conveyed to a fixer 13.

To the transfer sheet P, which has been transported to the fixer 13, heat and pressure is applied by a fixing roller pair 13*a*, and thereby the toner images are fixed to a surface of the transfer sheet P, such that a predetermined full-color image is formed. The transfer sheet P, on which the full-color image has been formed, is discharged onto a discharge tray 17 by a discharge roller pair 15 as it is (or after being directed by a branching unit 14 into a reverse transport path 18 and having an image formed on the other side, too).

Figure 2:
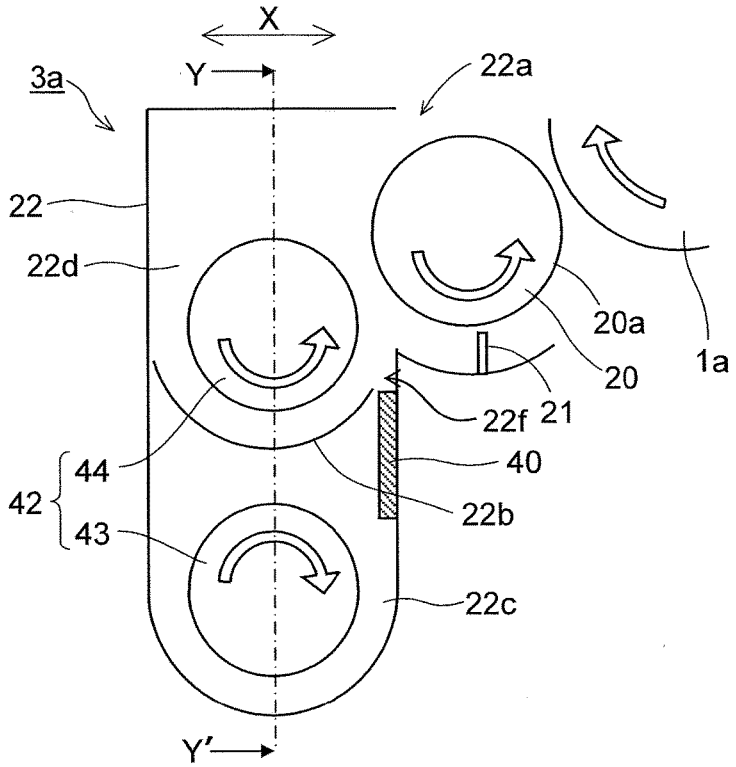
FIG. 2 is a side sectional view illustrating a structure of a developing device according to an embodiment of the present disclosure.

FIG. 2 is a side sectional view illustrating a configuration of the developing device 3*a* according to the embodiment of the present disclosure incorporated in the color printer 100. Here, the following description will be focused on the developing device 3*a* disposed in the image former Pa illustrated in FIG. 1, and the developing devices 3*b* to 3*d* arranged in the image formers Pb to Pd will not be described. This is because the developing devices 3*b* to 3*d* all have basically the same structure as the developing device 3*a*. Further, what is illustrated in FIG. 2 is the developing device 3*a* as seen from a rear side of FIG. 1, so that arrangement of components in the developing device 3*a* appears to be reversed left to right as compared with FIG. 1. As illustrated in FIG. 2, the developing device 3*a* includes a developing roller (developer carrier) 20, a stirring-conveyance member 42, and a developing container 22.

The developing container 22 forms a housing of the developing device 3*a*, and is divided, by a partition 22*b*, into a first conveyance chamber 22*c* and a second conveyance chamber 22*d*. The first conveyance chamber 22*c* and the second conveyance chamber 22*d* hold therein a two-component developer including a toner and a carrier. The developing container 22 rotatably holds the stirring-conveyance member 42 and the developing roller 20. Furthermore, in the developing container 22, an opening 22*a* is formed through which the developing roller 20 is exposed toward the photosensitive drum 1*a*.

The stirring-conveyance member 42 includes two spirals, namely, a first spiral (a first stirring-conveyance member) 43 and a second spiral (a second stirring-conveyance member) 44. The first spiral 43 is disposed in the first conveyance chamber 22*c*, at a position below the second spiral 44. The second spiral 44 is disposed in the second conveyance chamber 22*d* disposed above the first conveyance chamber 22*c*.

The first and second spirals 43 and 44 stir the developer to charge the toner in the developer to a predetermined level. This enables the toner to be held on the carrier. Furthermore, at both end portions of the partition 22*b* in its longitudinal direction (a direction perpendicular to the sheet on which FIG. 2 is drawn), the partition 22*b* dividing the first conveyance chamber 22*c* and the second conveyance chamber 22*d* from each other, communication portions (a first communication portion 22*e* and a second communication portion 22*f* in FIG. 3) are disposed. When the first spiral 43 rotates, the developer, which is charged, is conveyed to the second spiral 44 through one of the communication portions disposed at the partition 22*b*, and the developer is conveyed to the first spiral 43 through the other one of the communication portions, whereby the developer circulates in the first conveyance chamber 22*c* and the second conveyance chamber 22*d*. Then, the developer is supplied from the second spiral 44 to the developing roller 20 to form a magnetic brush on the developing roller 20.

The developing roller 20 includes a fixed shaft (not shown) and a developing sleeve 20*a*. The fixed shaft has secured thereto a magnet (not shown) having a plurality of magnetic poles, and rotatably holds the developing sleeve 20*a*. Near the developing sleeve 20*a*, a regulation blade 21 is disposed at a predetermined distance from the developing sleeve 20*a*. The regulation blade 21 regulates the layer thickness of the magnetic brush formed on the surface of the developing sleeve 20*a*. The developing sleeve 20*a* is caused to rotate in a direction (a counter-clockwise direction) indicated by an arrow in FIG. 2 by a driving mechanism including a motor and a gear, of which none is illustrated. Furthermore, to the developing sleeve 20*a*, a developing bias is applied which is obtained by superposing an alternating current voltage on a direct current voltage.

When the developing sleeve 20*a*, to which the developing bias is applied, rotates in the counter-clockwise direction in FIG. 2, a potential difference between the developing bias and the exposed portion of the photosensitive drum 1*a* causes the toner carried on the surface of the developing sleeve 20*a* to be supplied to the photosensitive drum 1*a*. The toner sequentially adheres to the exposed portion on the photosensitive drum 1*a* rotating in the clockwise direction, and an electrostatic latent image on the photosensitive drum 1*a* is developed with the toner.

Figure 3:
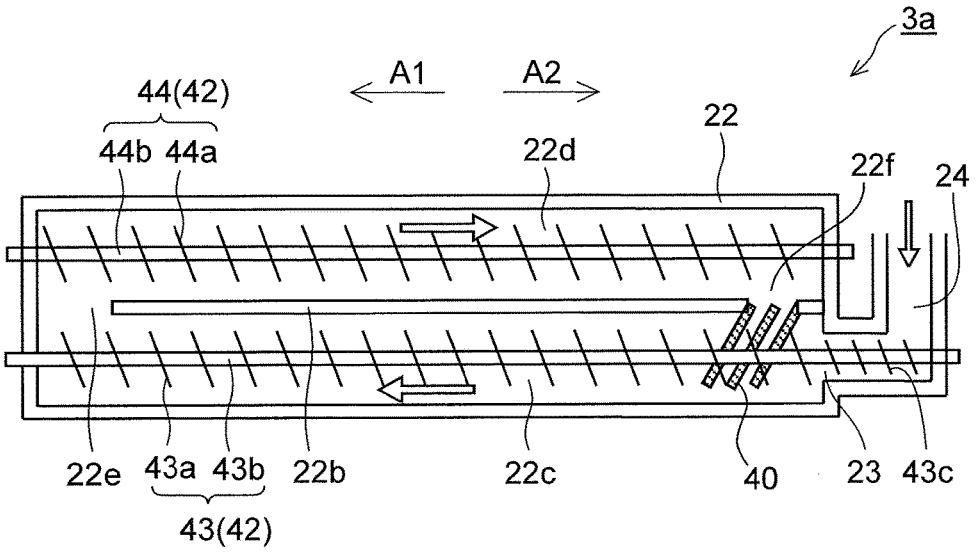
FIG. 3 is a vertical sectional view illustrating a structure of a stirring unit of the developing device of the present embodiment.

FIG. 3 is a vertical sectional view (taken along line YY' of FIG. 2) illustrating a structure of a stirring unit of the developing device 3*a*. As illustrated in FIG. 3, the developing container 22 includes the partition 22*b*, the first conveyance chamber 22*c*, the second conveyance chamber 22*d*, the first communication portion 22*e*, and the second communication portion 22*f*.

The partition 22*b* extends in a longitudinal direction of the developing container 22 to divide the first conveyance chamber 22*c* and the second conveyance chamber 22*d* from each other such that they are arranged one above the other to be parallel to each other. The first communication portion 22*e* and the second communication portion 22*f* are respectively formed at one end and the other end (a downstream side end in an A1 direction and a downstream side end in an A2 direction) of the partition 22*b* in its longitudinal direction.

The first communication portion 22*e* allows the first conveyance chamber 22*c* and the second conveyance chamber 22*d* to communicate with each other at their end portions on the downstream side in the A1 direction (a first direction). The second communication portion 22*f* allows the first conveyance chamber 22*c* and the second conveyance chamber 22*d* to communicate with each other at their end portions on the downstream side in the A2 direction (a second direction). Here, the second communication portion 22*f* is formed large enough to prevent the developer conveyed by the second spiral 44 from stagnating. And the developer circulates in the first conveyance chamber 22*c*, the first communication portion 22*e*, the second conveyance chamber 22*d*, and the second communication portion 22*f*.

The first spiral 43, which is disposed inside the first conveyance chamber 22*c*, has a rotary shaft 43*b* and a first spiral blade 43*a* disposed integrally with the rotary shaft 43*b* and formed in a spiral shape with a predetermined pitch in the axial direction of the rotary shaft 43*b*. The rotary shaft 43*b* is rotatably supported in the developing container 22. The first spiral blade 43*a* rotates in the clockwise direction in FIG. 2, and thereby conveys the developer inside the first conveyance chamber 22*c* in the A1 direction (toward one side in the axial direction of the developing roller 20), while stirring the developer.

Furthermore, in an end surface of the first conveyance chamber 22*c* in the A2 direction, there is provided a toner replenishing port 23 through which the toner is replenished into the developing container 22. The toner replenishing port 23 has connected thereto a toner replenishing path 24, which is connected to the toner container 4*a* (see FIG. 1). The rotary shaft 43*b* is disposed to extend, passing through the toner replenishing port 23, into a toner replenishing path 24. The portion of the rotary shaft 43*b* that is disposed inside the toner replenishing path 24 has integrally formed thereon a replenishing blade 43*c*, which is formed in a shape of a spiral with a constant pitch in the axial direction of the rotary shaft 43*b*. The replenishing blade 43*c* is a spiral blade wound in the same direction (the same phase) as the first spiral blade 43*a*, and is formed with a smaller pitch and a smaller diameter as compared with the first spiral blade 43*a*.

The second spiral 44 disposed inside the second conveyance chamber 22*d* has a rotary shaft 44*b* and a second spiral blade 44*a* which is integrally formed with the rotary shaft 44*b* and which is formed in a shape of a spiral wound in the same direction (the same phase) as the first spiral blade 43*a*. The rotary shaft 44*b* is disposed parallel to the rotary shaft 43*b*, and is rotatably supported in the developing container 22. The second spiral blade 44*a* rotates in the counter-clockwise direction in FIG. 2, and thereby stirs and conveys the developer existing in the second conveyance chamber 22*d* in the A2 direction (a direction opposite to the A1 direction) to supply the developer to the developing roller 20 (see FIG. 2).

The second communication portion 22*f* is formed at an end portion of the partition 22*b* in a width direction (an arrow X direction) of the developing container 22. More specifically, as illustrated in FIG. 2, the second communication portion 22*f* is formed at an end portion of the partition 22*b* on a side (the right side in FIG. 2) at which the developer is lifted by the rotation (in the counter-clockwise direction in FIG. 2) of the second spiral 44. Hence, the direction (upward direction) in which the developer is stirred by the second spiral 44 near the second communication portion 22*f* is opposite to the direction (downward direction) in which the developer falls from the second conveyance chamber 22*d* into the first conveyance chamber 22*c*.

On the other hand, the first spiral 43 rotates in a direction (the clockwise direction in FIG. 2) opposite to the direction in which the second spiral 44 rotates, and thus, the direction (downward direction) in which the developer is stirred near the second communication portion 22*f* by the first spiral 43 and the direction in which the developer falls from the second conveyance chamber 22*d* into the first conveyance chamber 22*c* are the same.

The second communication portion 22*f* is formed with a width (length in the container width direction) of 2 mm or more in order to reduce clogging with the developer. Although not illustrated here, the first communication portion 22*e* is formed in a center portion of the partition 22*b* in the container width direction.

In the developing device 3*a*, as illustrated in FIG. 3, the developer inside the first conveyance chamber 22*c* is stirred and conveyed by the first spiral 43 to one side (first communication portion-22*e* side), and gradually accumulates on the one side of the first conveyance chamber 22*c*. The developer already existing on the one side of the first conveyance chamber 22*c* is pushed by the developer coming to the one side, and is pushed up into the second conveyance chamber 22*d* via the first communication portion 22*e*.

Then, the developer is stirred and conveyed by the second spiral 44 to the other side (second communication portion-22*f* side) and supplied to the developing roller 20. The developer remaining on the developing roller 20 without being used for development falls from the developing roller 20, and is collected in the second conveyance chamber 22*d*. Then, the collected developer is conveyed by the second spiral 44 to the other side of the second conveyance chamber 22*d*, and falls into the first conveyance chamber 22*c* via the second communication portion 22*f*.

In the developing device 3*a* of the present embodiment, the second conveyance chamber 22*d* is disposed above the first conveyance chamber 22*c*. That is, the first conveyance chamber 22*c* and the second conveyance chamber 22*d* are arranged one above the other. This makes it possible to make the developing device 3*a* compact in the horizontal direction. Here, in the color printer 100, four developing devices 3*a* to 3*d* are arranged in the horizontal direction, and thus, making the developing devices 3*a* to 3*d* compact particularly effective to the miniaturization of the color printer 100.

In the present embodiment, the second communication portion 22*f*, through which the developer falls from the second conveyance chamber 22*d* to the first conveyance chamber 22*c*, is formed at the end portion of the partition 22*b* on the side at which the developer is lifted by rotation of the second spiral 44. With this configuration, the direction in which the developer is stirred in the second conveyance chamber 22*d* by the second spiral 44 is opposite to the falling direction in which the developer falls from the second conveyance chamber 22*d* into the first conveyance chamber 22*c*, and thus the developer can be stirred more sufficiently.

Moreover, the direction in which the developer is stirred by rotation of the first spiral 43 and the falling direction in which the developer falls from the second conveyance chamber 22*d*, passing through the second communication portion 22*f*, into the first conveyance chamber 22*c* are the same, and this enables the developer to smoothly fall into the first conveyance chamber 22*c*.

Incidentally, the developing device 3*a* is shipped in a state where it already holds the developer therein, and hence, the developer adheres to the developing roller 20. When such a portion of the developing roller 20 to which the developer has adhered is exposed through the opening 22*a* of the developing container 22, the inside of the color printer 100 may become stained with the developer. To prevent this, at the time of shipping from the factory, the developing roller 20 is rotated backward to hide the portion with the developer inside the developing container 22.

Further, when the toner floating inside the developing container 22 accumulates around the regulation blade 21, such that the thus accumulated toner aggregates and adheres to the developing roller 20, they may eventually fall and cause an image defect. To prevent this, the developing roller 20 is rotated backward during a non image forming period to thereby collect the toner accumulated around the regulation blade 21 with the magnetic brush formed on the developing roller 20.

Here, the developing roller 20 is driven in many cases by the same common drive source (drive motor) that also drives the first spiral 43 and the second spiral 44. Thus, when the developing roller 20 is rotated backward as described above, the first spiral 43 and the second spiral 44 also rotate backward. As a result, the developer in the first conveyance chamber 22*c* is conveyed in the direction (the A2 direction) opposite to the direction (the A1 direction) in which the developer is normally conveyed, but the developer at the upstream-side end portion (the right end portion in FIG. 3) of the first conveyance chamber 22*c* is not allowed to move upward (in a direction toward the second communication portion 22*f*), and thus is compressed by the backward rotation of the second spiral 44, causing aggregation of the developer. Further, with the aggregation of the developer, an increased driving torque is required to rotate the first spiral 43.

Moreover, the toner replenishing port 23 is disposed on the upstream-side end portion (the right end portion in FIG. 3) of the first conveyance chamber 22*c*, and thus, when aggregation of the developer occurs at the upstream-side end of the first conveyance chamber 22*c*, it may prevent sufficient mixing of the replenished toner, replenished via the toner replenishing port 23 into the first conveyance chamber 22*c*, with the developer already existing in the first conveyance chamber 22*c*.

Thus, according to the present embodiment, a guide member 40 is provided which guides, to the downstream side in the direction (the A1 direction) in which the developer is conveyed inside the first conveyance chamber 22*c*, the developer conveyed from the second conveyance chamber 22*d*, passing through the second communication portion 22*f*, to fall into the first conveyance chamber 22*c*.

Figure 4:
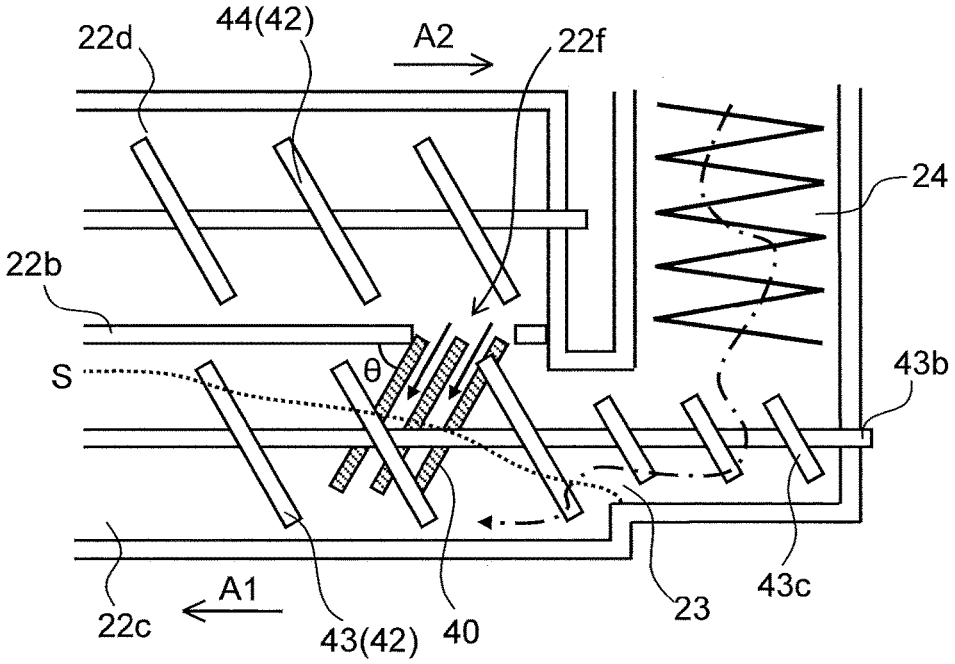
FIG. 4 is a partial enlarged view illustrating a second communication portion illustrated in FIG. 3 and an area around it.

FIG. 4 is a partial enlarged view illustrating the second communication portion 22*f* and an area around it illustrated in FIG. 3. The guide member 40 includes a plurality of (here, three) rib-shaped members which are disposed below the second communication portion 22*f*, and project into the first conveyance chamber 22*c* from an inner wall surface of the developing container 22 on a side (right side in FIG. 2) at which the second communication portion 22*f* is disposed. The guide member 40 is formed to be inclined downward at an angle of θ from the second communication portion 22*f* toward the downstream side in the A1 direction. Here, the guide member 40 may be formed independent of the developing container 22, or may be integrally formed with the developing container 22.

Further, the replenished toner, which is replenished through the toner replenishing path 24 and via the toner replenishing port 23, is conveyed along the rotary shaft 43*b* of the first spiral 43, and enters the first conveyance chamber 22*c* (as indicated by the dashed dotted line arrow in FIG. 4). Then, the replenished toner is charged to a predetermined charge amount by being stirred and mixed with the developer in the first conveyance chamber 22*c* (the developer which has fallen from the second conveyance chamber 22*d*).

The developer passing through the second communication portion 22*f* falls along the guide member 40 to an area downstream from an area directly under the second communication portion 22*f* in the developer conveyance direction (the A1 direction). As a result, the top surface of the developer in the first conveyance chamber 22*c* takes a sectional shape as indicated by the dotted line S in FIG. 4, and the amount of developer decreases at the end portion of the first conveyance chamber 22*c* on the upstream side (the right end portion in FIG. 4) in the developer conveyance direction (the A1 direction).

This helps alleviate the developer compressing effect caused at the upstream side end portion of the first conveyance chamber 22*c* in the developer conveyance direction (the A1 direction) when the first spiral 43 rotates backward, and thus it is possible to reduce the aggregation of the developer and the thereby caused increase of the driving torque to rotate the first spiral 43.

It is also possible to fully mix the replenished toner, which has been replenished through the toner replenishing port 23 to the upstream side of the first conveyance chamber 22*c*, with the developer in the first conveyance chamber 22*c* (the developer which has fallen from the second conveyance chamber 22*d*), and thus to reduce occurrence of fogged images and toner scattering.

The embodiments described above are in no way meant to limit the present disclosure, which thus allows for many modifications and variations within the spirit of the present disclosure. For example, the above embodiment has dealt with an example where the developer is supplied to the developing roller 20 from the second spiral 44, but this is by no means meant to limit the present disclosure. A developer carrier such as a magnetic roller or a like may further be disposed between the second spiral 44 and the developing roller 20, such that the developer is supplied from the second spiral 44 to the magnetic roller or the like, and then the developer is supplied from the magnetic roller or the like to the developing roller 20.

Furthermore, the above embodiment has a configuration in which the replenished toner is conveyed along the rotary shaft 43*b* of the first spiral 43 to enter the upstream side end portion of the first conveyance chamber 22*c* in the developer conveyance direction in the first conveyance chamber 22*c*, but alternatively, the replenished toner may fall, from above, into the upstream side end portion of the first conveyance chamber 22*c* in the developer conveyance direction. In the case of the configuration where the replenished toner falls from above, when a large amount of developer exists in the upstream side end portion of the first conveyance chamber 22*c*, the fallen replenished toner stays and accumulates on the developer, and such replenished toner is likely to be conveyed in a floating state, which may prevent sufficient mixing of the replenished toner with the developer in the first conveyance chamber 22*c*. In the configuration where the replenished toner falls from above, too, it is advantageous to provide the guide member 40 as in the present embodiment to thereby reduce the amount of developer in the upstream side end portion of the first conveyance chamber 22*c*.

Further, the present disclosure is applicable not only to the tandem type color printer 100 as illustrated in FIG. 1, but also to various image forming apparatuses including both digital and analog types of monochrome copiers, color copiers, facsimile machines, and so on which each incorporate a developing device including a first conveyance chamber and a second conveyance chamber disposed above the first conveyance chamber. Below, by way of practical examples, the effects of the present disclosure will be described more specifically.

EXAMPLE

Using the developing device 3*a* illustrated in FIG. 2 and FIG. 3, a survey was conducted on the mixability of replenished toner and the occurrence of developer aggregation when the developing device 3*a* is driven to rotate backward. A confirmatory test for the mixability of replenished toner were conducted in such a manner that, after the developing device 3*a* was driven while replenishing toner through the toner replenishing port 23, the developing device 3*a* was stopped, and the state of the replenished toner in the developing container 22 was visually checked.

A confirmatory test for the occurrence of developer aggregation caused by the backward rotation driving were conducted in such a manner that, with a predetermined amount of developer fed into the developing device 3*a*, the developing device was driven by means of an external driving device and a cycle of 2-second forward rotation (in the rotation direction during development) and 0.5-second backward rotation was repeated 1000 times. Then, the developer was taken out of the developing device 3*a* to check for the presence/absence of a developer aggregation by using a sieve (mesh) with 149-μm pores.

The developing roller 20 used in the developing device 3*a* had a developing sleeve 20*a* with an external diameter of 16 mm, a fixed shaft rotatably supporting the developing sleeve 20*a*, and a four-magnetic-pole magnet secured to the fixed shaft, and the developing roller 20 was rotated at the rotation rate of 366 rpm. The first spiral 43 and the second spiral 44 used in the developing device 3*a* each had a rotary shaft and a double-threaded spiral blade with an outer diameter of 16 mm and a pitch of 30 mm and formed on an outer peripheral surface of the rotary shaft, and the first spiral 43 and the second spiral 44 were rotated at a rotation rate of 326 rpm.

As for the second communication portion 22*f* of the developing container 22, the dimension thereof in the direction of the width of the developing container 22 (the arrow X direction) was set to 5 mm, and the second communication portion 22*f* was opened over a range from a side edge (the right edge in FIG. 2) of the partition 22*b* to a position 5 mm away from the side edge in the width direction, and the dimension thereof in the developer conveyance directions (the A1, A2 directions) was set to 10 mm, and the second communication portion 22*f* was opened over a range from a position 3 mm away from a side edge (the right edge in FIG. 3) of the partition 22*b* to a position 13 mm away from the side edge in the axial direction of the partition 22*b*. Further, three guide members 40, which were each inclined at an angle θ of 60° with respect to the horizontal direction, were disposed under the second communication portion 22*f* at intervals of 3 mm.

As the developer, a two-component developer was used which included a positively chargeable toner with an average particle diameter of 6.8 μm and a ferrite carrier with an average particle diameter of 38 μm. The ratio of the carrier with respect to the toner (in the weight ratio, T/C) was 8%. The amount of developer put in the developing device 3*a* was 150 g.

From the results of the tests, it was confirmed that mixing of the developer in the developing container with the replenished toner by stirring in the developing container 22 was promoted, without any replenished toner observed stagnating at the bottom of the developing container 22 or floating above the developer surface. Further, no developer aggregation was caused by the backward rotation driving.

The present disclosure is usable in a developing device having a first conveyance chamber and a second conveyance chamber disposed above the first conveyance chamber. With the present disclosure, it is possible to provide a developing device capable of alleviating compression of developer in an upstream side end portion of the first conveyance chamber caused by a backward rotation of a stirring-conveyance member, and also capable of sufficiently mixing toner replenished to the upstream side end portion of the first conveyance chamber with the developer in the first conveyance chamber, and an image forming apparatus including such a developing device.

What is claimed is:

1. A developing device comprising:

a developing container which includes a first conveyance chamber, and a second conveyance chamber disposed above the first conveyance chamber with a partition therebetween, the developing container holding therein a two-component developer including a carrier and a toner;

a first stirring-conveyance member which is rotatably supported in the first conveyance chamber and conveys the developer in the first conveyance chamber in a first direction, while stirring the developer;

a second stirring-conveyance member which is rotatably supported in the second conveyance chamber to be parallel to the first conveyance member, and rotates in a direction opposite to a direction in which the first stirring-conveyance member rotates, to thereby convey the developer in the second conveyance chamber in a second direction which is opposite to the first direction; and a developer carrier which is rotatably supported in the developing container and carries on a surface thereof the developer in the second conveyance chamber;

wherein the developing container includes a first communication portion which allows the first conveyance chamber and the second conveyance chamber to communicate with each other at end portions thereof on a downstream side in the first direction, a second communication portion which allows the first conveyance chamber and the second conveyance chamber to communicate with each other at end portions thereof on a downstream side in the second direction, and which is formed at an end portion of the partition on a side in a width direction of the developing container which is perpendicular to an axial direction of the second stirring-conveyance member, the end portion being a downstream-side end portion of the partition with respect to a moving direction of such a portion of each of the second stirring-conveyance member and the first stirring-conveyance member as faces the partition, and a guide member which is disposed in the first conveyance chamber, and guides, to the downstream side in the first direction, the developer that is conveyed from the second conveyance chamber, passing through the second communication portion, and falls into the first conveyance chamber, and the guide member is a rib-shaped member which is formed to be inclined downward from the second communication portion toward the downstream side in the first direction.

2. The developing device according to claim 1, wherein the guide member includes a plurality of guide members which are disposed below the second communication portion to project parallel to each other into the first conveyance chamber from an inner wall surface of the developing container on a side at which the second communication portion is formed.

3. The developing device according to claim 1, further comprising a toner replenishing port which is disposed at an end portion of the first conveyance chamber on the downstream side in the second direction, and through which the toner is replenished into the first conveyance chamber along a rotary shaft of the first stirring-conveyance member.

4. The developing device according to claim 1, wherein the first stirring-conveyance member is rotatable in a direction opposite to a direction in which the first stirring-conveyance member rotates during image formation.

5. An image forming apparatus comprising the developing device according to claim 1.

* * * * *